United States Patent [19]

Mrdjenovich

[11] 4,137,071

[45] Jan. 30, 1979

[54] LOW COST METHOD OF FLUIDIZING CUPOLA SLAG (A)

[75] Inventor: Robert Mrdjenovich, Trenton, Mich.

[73] Assignee: Ford Motor Company, Dearborn, Mich.

[21] Appl. No.: 535,545

[22] Filed: Dec. 23, 1974

[51] Int. Cl.[2] ..... C21B 3/02

[52] U.S. Cl. ..... 75/30; 75/43; 75/257

[58] Field of Search ..... 75/30, 94, 43, 44, 130, 75/55, 257

[56] References Cited

U.S. PATENT DOCUMENTS

| | | | |
|---|---|---|---|
| 1,590,730 | 6/1926 | Evans | 75/55 |
| 1,963,269 | 6/1934 | Hennig | 75/43 |

*Primary Examiner*—M. J. Andrews

*Attorney, Agent, or Firm*—Joseph W. Malleck; Olin B. Johnson

[57] ABSTRACT

A method of fluxing and fluidizing the slag in a cupola by adding to the charge therein a fluxing material comprising, by weight percentage relative to the metal charge, 3-5% $CaCo_3$ (limestone), 3-5% $MgCO_3 \cdot CaCO_3$ (dolomite), and 1-2% $Na_2CO_3$ (fused soda ash). This fluxing and fluidizing material is used for operating a basic cupola and is used in amounts ranging from about 7 to 12 by weight of the metal charge. The flux material serves to remove impurities from the metal, and improve the combustion efficiency of the coke. In an acid slag cupola, the flux will increase fluidity. In a basic slag, a fluidizer serves to improve the fluidity of the slag, while offering no injurious by-products that would interfere with emission control elements, and additionally insures a lower cost fluxing material as compared to current basic operated cupola practices.

4 Claims, 1 Drawing Figure

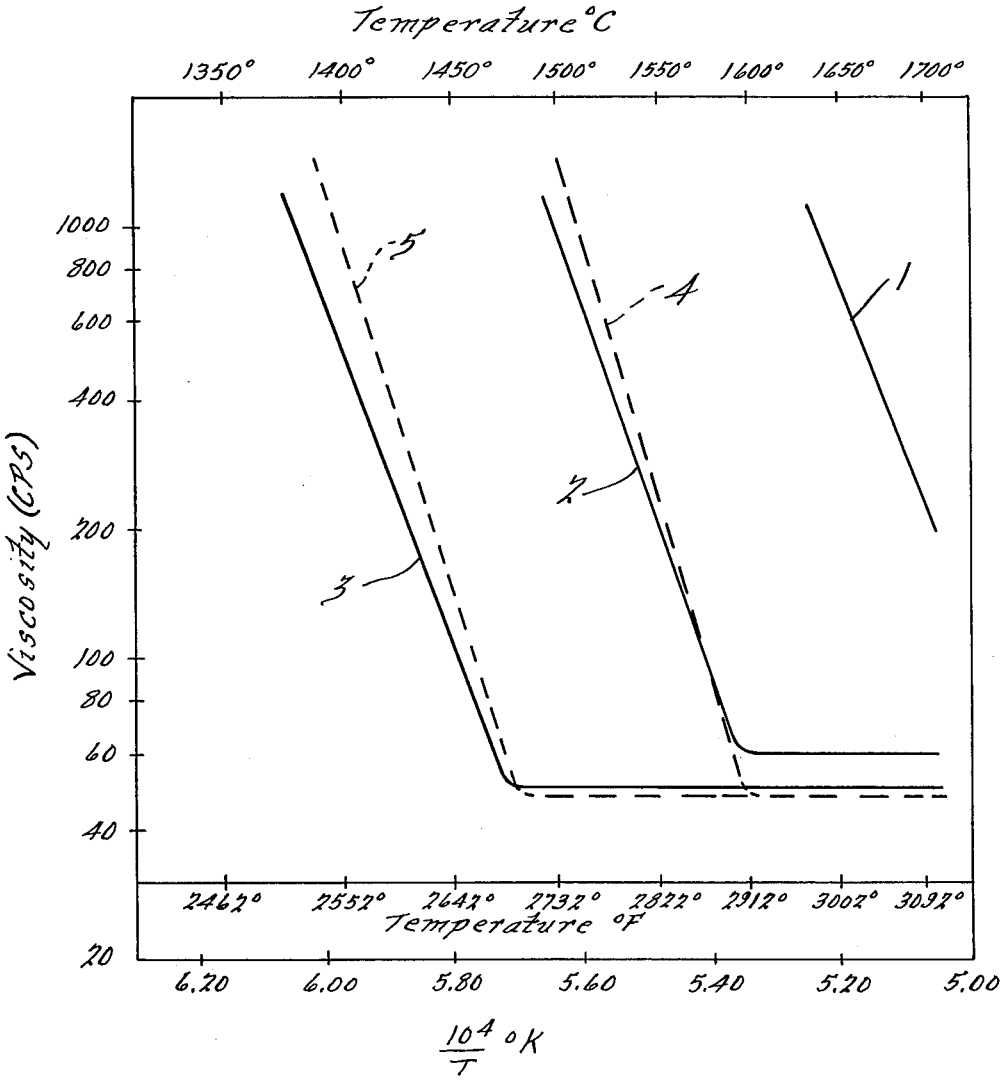
Temperature °C
1350° 1400° 1450° 1500° 1550° 1600° 1650° 1700°
Viscosity (CPS)
1000
800
600
400
200
100
80
60
40
20
5
4
1
2
3
2462° 2552° 2642° 2732° 2822° 2912° 3002° 3092°
Temperature °F
6.20 6.00 5.80 5.60 5.40 5.20 5.00
$\frac{10^4}{T}$ °K

LOW COST METHOD OF FLUIDIZING CUPOLA SLAG (A)

BACKGROUND OF THE INVENTION

The operation of cupolas with basic slags has, as its principal objective, the production of low sulfur and/or high carbon irons. The basic cupola is used extensively for making base iron for nodular iron because low sulfurs are easily obtainable along with the higher carbon levels that are typically desired. One of the disadvantages of using such a basic slag operated cupola is the cost of fluxing material which typically exceeds that of an acid operating cupola. Fluxes should lower the fusion point and improve the fluidity of the slag naturally produced in the melting operation; the fluid condition of the slag will influence physical cleanliness, the various reactions, and the combustion efficiency of the cupola. Although a natural slag is formed by non-metallic products such as coke ash, dirt or entrapped sand obtained in the metal charge, and oxidized metallics from melting operations, the properties of the natural slag will be altered by the addition of fluxing agents, such as limestone, which ultimately becomes part of the slag.

A flux is here used to mean a material that reacts with the natural slag to increase the fluidity and refining value thereof. Limestone is vital in controlling the desulfurization reaction in the basic operated cupola. Within certain limits, limestone additions depress the slag fusion point, but excess limestone will increase the slag fusion point. Furthermore, the slag fusion point will increase in operations that strive for strict control of low sulfur levels in the base iron composition. Therefore, special or secondary fluxing agents (referred to as fluidizers) have been resorted to in an effort to reduce the slag fusion point and accelerate the solution of lime thereby insuring the occurrence of required basic slag refining reactions.

To do this, the prior art has turned principally to the use of fluorspar usually added in the form of calcium fluoride. This material has proved capable of providing a highly fluid slag. However, with the advent of stricter environmental restrictions on emissions from a cupola, it has been found that hydrofluoric acid, formed as the reaction gas from the use of calcium fluoride, deteriorates fiberglas-type bags utilized to collect the residue and particles in the effluent. Hydrofluoric acid gas will fog and deteriorate the effectiveness of the collection elements much earlier than their normal expectancy. Additionally, the cost of calcium fluoride has risen to unprecedented heights, causing cupola operators to turn to more economical substitutes that will not only perform well as the secondary fluidizer but eliminate the problem relating to baghouse collection.

Unfortunately, there has been no available alternative fluidizers that would meet the triple goals of (a) achieving greater economy compared to fluorspar, (b) improving fluidity by decreasing the fusion point of the slag and thereby be equivalent to the effectiveness of fluorspar, and (c) the elimination of the bag-house problem. Since these triple goals cannot be solved simultaneously by the knowledge of the prior art to date, the present invention has undertaken to re-analyze the function and capabilities of traditional materials in proportions heretofore not used.

SUMMARY OF THE INVENTION

The primary object of this invention is to provide a fluxing material utilizable in the production of iron in a basic operated cupola, the material being free of fluorspar and yet capable of achieving high fluidity or fusion temperature conditions for the slag. The fluxing material should provide improved economy compared to the use of fluorspar and, in those instances where emission control elements have heretofor been affected by the use of fluorspar, destruction of such elements should be eliminated.

Another object of this invention is to provide a method of making nodular cast iron which includes in the makeup of the fluxing composition, the use of increased amounts of dolomite.

Particular features pursuant to the above objects include the use of between 6–12 MgO as a replacement for a comparable amount of calcium oxide units normally supplied by limestone, the latter being an essential ingredient for making a slag in a system having 44–60% CaO, 23–30% $SiO_2$, 3–7% MgO, about 6.5% $Al_2O_3$, 1% nominal S and remaining compounds totally up to 1%. In addition, between 1–3% soda ash is substituted for between 2.0–4.5% fluorspar in the traditional flux make-up.

SUMMARY OF THE DRAWING

FIG. 1 is a graphical illustration of the variation of viscosity of specific slag compositions with temperature.

DETAILED DESCRIPTION

A flux formulation for a metal charge of 4000 lbs. was prepared utilizing approximately 180 lbs. of limestone ($CaCO_3$), about 120 lbs. of dolomite $MgCO_3 . CaCO_3$), 50 lbs. of fused soda ash ($Na_2CO_3$). The soda ash was formed as a briquette using a ratio of 27% $Na_2CO_3$ with 65% dolomitic limestone and a binder. If the soda ash were introduced to the cupola opration in the unmixed form, certain disadvantages would result. Forty pounds of foundry grade $CaC_2$ were used also. If the calcium carbide was not used, the limestone would be increased to 220 lbs.

The flux materials were added to the cupola in incremental amounts over a period of seven hours; the previously used fluxing material (standard) in the cupola was allowed approximately one hour to work its way through the cupola system. The standard slag and fluxing composition constituted the base line analysis and had properties over which this invention defines an improvement.

The amount of flux composition utilized constituted 10% of the metal charge weight (4000 lbs. including alloys). The amount of flux used relative to the metal charges is important; the amount is dependent upon the cleanliness of the scrap, and desired sulfur levels in the metal and may range for basic or neutral operation, from 2.5 to 12% and more. An excessively high flux addition should be avoided for economic reasons as well as adversely affecting melt rate. Dirty, fine charges and intermitent tapping require more flux while continuously operating hotter cupolas require less.

It was found and observed visually that the slag throughout the cupola operation, during which time the new slag herein was operative, was highly fluid and did not provide any hang-ups or bridges within the cupola. It was found that this flux composition will give excellent results without the disadvantages of fluxes incorporating fluorspar heretofore.

For purposes of this invention, the fluxing composition should contain, by weight, from 3.5–5.5% limestone (preferably about 4.5%), from 2.5–5.5% dolomitic limestone (preferably about 4.5%) and from 1–2.5% fused soda ash (preferably about 1.2–2%), taken with respect to the weight of the metal charge.

For the specific slag composition, obtained from the above cupola trial, the slag analysis revealed that there was 48% CaO, 33% $SiO_2$, 3.4 $Na_2O$, 7.5% $Al_2O_3$, 4.6% MgO, 1.2% MnO, 0.05% $P_2O_5$, 0.28% Fe, and 1.27% sulfur. For purposes of this invention, the slag analysis should be maintained within the following range 45–55% CaO, 2–4% $Na_2O$, 0.2–1.3% MnO, 23–33% $SiO_2$, 5.5–7.5% $Al_2O_3$, 6–10% MgO (preferably 8%) over the base line MgO content which will most often render an MgO content of 9–15% and less than 0.2% $CaF_2$.

The flux composition of this invention has proved to be functionally equivalent on a pound per pound basis with commercially available fluoride containing fluxes comprised of about an equal mixture of fluorspar and limestone. However, the flux of the instant invention is not attended with the prevalence of gaseous fluorides which are released at high temperatures from the fluoride containing fluxes and the cost factor is reduced since more economical dolomitic limestone is used to carry fluidizing units as a substitute for a portion of the fluidizing units of fluorspar.

Magnesia has become an important substitute in this invention as a fluidizing agent. More importantly though, the magnesia units required not only displace an equal number of units of lime normally contained in a standard slagging composition, but work in synergism with additions of fused soda ash to replace the previously required units of fluorspar.

It has been found most suprisingly that additional units of magnesia may be provided by reducing the normally required limestone requirements and introducing an equal amount of dolomite. Dolomite contains about 45% magnesium carbonate and begins to decompose at about 662° F.; at the lower temperature ranges, the reaction proceeds at a faster rate than it does in the case of high calcium stone. In general, lighter weight and porous dolomitic stones not only decompose into the oxide more rapidly than the denser types, but the calcined form is softer and more friable and is broken up or crushed by the movement of the coke and iron charge in settling downwardly through the cupola. Thus with the more porous stone and with smaller sized stone, because of the greater surface area and more rapid decomposition, fluxing will occur higher up in the stack and the reactions will proceed at a faster rate. For best results, the screen size of the fluxing stone should be controlled in accordance with its calcining characteristics, depth of the cupola charge, rate of travel through the stack and the temperatures existing at different levels in the stack down to the melting zone.

Turning now to FIG. 1, comparative viscosity tests were made starting with a standard or base slagging composition utilized in the industry (see plot 1); this was compared against the same standard slag with fluorspar additions (plot 2 with 7.5% $CaF_2$ and plot 3 with 12.5% $CaF_2$). A modified slag, in accordance with this invention, is represented by plot 4 and a modified slag with 3% soda ash would lie between plots 3 and 4. The viscosity or fluidity data were generated using 80 gram slag samples prepared in the laboratory; similar data were determined for actual cupola slags. The viscosity data were determined using a Brookfield viscometer calibrated for a range between 500–6000 centipoise. Additional data were determined on another Brookfield instrument calibrated for a viscosity range between 40–1000 centipoise. The flux of this invention will provide a slag having a viscosity of at least 500 cps at operating temperatures.

Plot 1, for a standard slag composition, contains no fluorspar, 60% CaO, 30% $SiO_2$, 6.5% $Al_2O_3$, 7% MgO, 0.36% MnO, 0.38% $P_2O_5$, 0.33% Fe and 1.2% sulfur. Note that the standard slag, without the spar fluidizer is relatively viscous at the melting temperatures of the cupola. The fusion point (pyrometric cone equivalent) for such a standard slag has been measured to be about 2690° F. When spar is added in a proportion of about 7.5% or 12.5% viscosity plots 2 and 3 were generated. This slag proved to be satisfactorily fluid with a break point below 2200° F.

Plot 4 is for a glas that had 8 units of lime replaced by eight units of magnesium oxide; in production melting, this is provided by increasing the dolomitic content of the charging materials. The slag analysis for plot 4 showed 52% CaO, 31% $SiO_2$, 6.5% $Al_2O_3$, 14.9% MgO, 0.45 MnO, 2.4% $P_2O_5$, 0.36% Fe, and 1.05% sulfur. Viscosity plot 4 is slightly more viscous than the standard slagging composition 2 containing 7.5% spar.

Plots 4 and 5 represent the preferential slagging composition range of this invention, the viscosity curves being comparable in performance to a high fluorspar type slagging composition. The slagging composition included 3% soda ash and had an analysis comprised of: 48–50% CaO, 1.2–1.3% MnO, 33% $SiO_2$, 7.5% $Al_2O_3$, 5% MgO, 2.5–3.5% $Na_2O$ and between 1–2% sulfur. A suitable fluxing material may be formed as a briquette employing 50–75% dolomitic limestone and 25–50% fused soda ash; the briquette may include a suitable binder (usually 7%) to bind the materials under ambient temperatures.

Proof of increased fluidity resulting from following the inventive method is provided by visual observation, lower viscosity data and a drop in the fusion point. Fusion point data is generated according to the ASTM-C24 cone slump test and is generally accepted. The fusion point is defined as that temperature at which the tip of a prepared cone, which rests inclined on a ceramic plaque, slumps to the point where the cone tip contacts the ceramic plaque. Fusion point data is useful in establishing relative trends related to compositional variations. If care is taken in the interpretation of the fusion point data, it can be related to the fluidity of the slag; such interpretation must allow for the fact that the slump or fusion point is measured in the high viscosity region of the viscosity curve, while slag fluidity in melting operations is generally referenced at operating temperatures, or the low viscosity region of the viscosity curve. In any event, a significant drop in the fusion point was proven by use of the suggested slag ingredients.

It is to be understood that various modifications and changes can be made in the foregoing method and slagging composition without departing from the spirit and scope of the invention as defined by the appended claims.

I claim as my invention:

1. A method of fluxing slag in a basic operated cupola for making low sulfur and/or high carbon irons, by adding to the cupola charge therein an effective amount of fluxing materials comprising, by weight in the slag analysis 45–55% CaO, 9–15% MgO, 2–4% $Na_2O$, about 6.5% $Al_2O_3$, about 23–33% $SiO_2$, and less than 0.2% $CaF_2$.

2. The method as in claim 1, in which the fluxing materials constitute about 2.5–12% by weight of the total metal charge for said cupola.

3. The method as in claim 1, in which the fluxing materials are effective to obtain a viscosity for the resultant slag which is at least as fluid as 500 cps at operating temperatures and has a fusion temperature which is at least 2300° F.

4. The method as in claim 1, in which MgO of said slag analysis is derived from fluxing materials having dolomitic limestone and said $Na_2O$ of said slag analysis is derived from fluxing materials having fused soda ash, said fluxing materials being formed as a briquette comprised of a mixture of dolomitic limestone (75–50%) and fused soda ash (25–50%). /

* * * * *